US007497349B2

(12) United States Patent
Allen

(10) Patent No.: US 7,497,349 B2
(45) Date of Patent: Mar. 3, 2009

(54) TRAVEL MUG

(75) Inventor: Jesse Franklin James Allen, 1735 Highway 15, R.R.3, Elgin, Ontario (CA) K0G 1E0

(73) Assignee: Jesse Franklin James Allen, Elgin, Ontario (CA)

( * ) Notice: Subject to any disclaimer, the term of this patent is extended or adjusted under 35 U.S.C. 154(b) by 576 days.

(21) Appl. No.: 11/104,520

(22) Filed: Apr. 13, 2005

(65) Prior Publication Data

US 2006/0231559 A1 Oct. 19, 2006

(51) Int. Cl.
*A47G 19/22* (2006.01)
*B65D 25/04* (2006.01)

(52) U.S. Cl. ..... 220/501; 220/527; 220/718

(58) Field of Classification Search ..... 220/501, 220/502, 506, 713, 714, 711, 719, 351, 253, 220/592.17, 555, 717, 718, 527
See application file for complete search history.

(56) References Cited

U.S. PATENT DOCUMENTS

| | | | | | |
|---|---|---|---|---|---|
| 4,437,576 | A * | 3/1984 | Barniak | 220/710 |
| 4,582,218 | A | 4/1986 | Ross | |
| 5,217,141 | A | 6/1993 | Ross | |
| 5,224,646 | A * | 7/1993 | Biancosino | 229/4.5 |
| 5,249,703 | A | 10/1993 | Karp | |
| 5,560,513 | A * | 10/1996 | Jarrell | 220/705 |
| 5,570,797 | A * | 11/1996 | Yeh | 215/228 |
| 5,607,076 | A * | 3/1997 | Anthony | 220/501 |
| D396,381 | S | 7/1998 | Chung | |
| 5,975,333 | A | 11/1999 | Lee | |
| D431,159 | S | 9/2000 | Otake | |
| 6,182,854 | B1 * | 2/2001 | Jimenez et al. | 220/705 |
| 6,305,571 | B1 * | 10/2001 | Chu | 220/719 |
| 6,318,584 | B1 * | 11/2001 | Milan | 220/713 |
| 6,367,652 | B1 * | 4/2002 | Toida et al. | 220/739 |
| D492,546 | S | 7/2004 | Bodum | |
| D502,844 | S | 3/2005 | Rohe | |
| 7,156,255 | B2 * | 1/2007 | Raft | 220/603 |
| 7,210,596 | B1 * | 5/2007 | Ruccolo | 220/23.87 |
| 2005/0115977 | A1 * | 6/2005 | Dibdin et al. | 220/714 |
| 2006/0169694 | A1 * | 8/2006 | Kemper | 220/303 |

OTHER PUBLICATIONS

Office Action issued in corresponding Canadian Patent Application No. 2,532,401 mailed Aug. 26, 2008.

* cited by examiner

*Primary Examiner*—Anthony D Stashick
*Assistant Examiner*—Niki M Eloshway
(74) *Attorney, Agent, or Firm*—Matthew M. Roy; Gowlings, LLP

(57) ABSTRACT

A travel mug that protects the user from beverage leaks has an outer sidewall with a top rim that defines an open mouth from which a beverage can be consumed, an inner sidewall having an open top end for receiving a lid for closing the open top end, and a fluid reservoir between the outer sidewall and the inner sidewall, the fluid reservoir having a bottom surface that is spaced beneath the open top end of the inner sidewall.

20 Claims, 6 Drawing Sheets

TRAVEL MUG

CROSS-REFERENCE TO RELATED APPLICATIONS

This is the first application filed for the present invention.

MICROFICHE APPENDIX

Not Applicable.

TECHNICAL FIELD

The present invention relates to fluid containers and, in particular, to a travel mug that significantly reduces the probability of drips or leaks while a user consumes a beverage from the mug.

BACKGROUND OF THE INVENTION

Mugs having covers for maintaining a temperature of a beverage are well know and are available in wide variety of models and designs. Such mugs typically have a friction fit or threaded closure for inhibiting fluid spilling from the mug when the mug is jostled or tipped. Such mugs have a joint between the sidewall of the mug and a sidewall of the lid. The lid typically comprises an upstanding rim that surrounds a well into which the beverage enters through one or more fluid passages as the beverage is consumed.

A long standing problem with such mugs is providing a secure seal between the lid and the mug. A great deal of inventive ingenuity has been invested in designing fluid seals and precession molds for ensuring that leakage does not occur between the lid and the mug because such leakage inevitably dribbles the beverage onto clothing of the user. However, it is well know that even the best of such mugs will leak if the lid is worn or improperly secured. Besides, even a good seal may seep fluid due to surface tension and capillary action if the lid is secured when the joint is not dry.

This problem has been eliminated by mugs having solid outer sidewalls with recessed lids, such as described in U.S. Pat. No. 4,582,218 which issued on Apr. 15, 1986 to Ross; U.S. Pat. No. 5,249,703 which issued Oct. 5, 1993 to Karp; and U.S. Pat. No. 5,217,141 which issued on Jun. 8, 1983 to Ross. Although the mugs described by Ross and Karp eliminate leakage between the lid and the mug, they have the disadvantage of a recessed lid that may be soiled by the beverage consumed. Consequently, handling the lid may be messy and potentially unhygienic.

This problem is partially addressed by U.S. Design Pat. 396,381 which issued on Jul. 28, 1998 to Chung Young. However, a disadvantage of Young's design is that a fluid-tight seal is required between the lid and the inner side of the mug to ensure that fluid does not dribble onto the user when a beverage is being consumed.

There therefore exists a need for a travel mug that provides improved security against leaks or drips when a beverage is consumed from the mug.

SUMMARY OF THE INVENTION

It is therefore an object of the invention to provide a travel mug that reduces the probability of leaks or drips while a beverage is being consumed from the mug.

In accordance with one aspect of the invention there is provided a travel mug, comprising an outer sidewall having a top rim defining an open mouth from which a beverage can be consumed; an inner sidewall having an open top end for receiving a lid for closing the open top end; and a fluid reservoir between the outer sidewall and the inner sidewall, the fluid reservoir having a bottom surface that is spaced beneath the open top end of the inner sidewall.

In accordance with another aspect of the invention there is provided a travel mug, comprising in combination an outer sidewall having a top rim defining an open mouth from which a beverage can be consumed; an inner sidewall having an open top end for receiving a lid for closing the open top end; a fluid reservoir between the outer sidewall and the inner sidewall, the fluid reservoir having a bottom surface that is spaced beneath the open top end of the inner sidewall; and the lid for closing the open top end comprises a first and second fluid passage, the first fluid passage providing a pathway for the beverage consumed and the second fluid passage providing a pathway for air to enter as beverage flows through the first fluid passage.

In accordance with yet a further aspect of the invention there is provided a travel mug, comprising in combination an outer sidewall having a top rim defining an open mouth from which a beverage can be consumed; an inner sidewall having an open top end for receiving a lid for closing the open top end; a fluid reservoir between the outer sidewall and the inner sidewall, the fluid reservoir having a bottom surface that is spaced beneath the open top end of the inner sidewall; and the inner sidewall further comprises a first and second fluid passage located between the open top end and the bottom surface of the fluid reservoir, the first fluid passage providing a pathway for the beverage consumed and the second fluid passage providing a pathway for air to enter as beverage flows through the first fluid passage.

BRIEF DESCRIPTION OF THE DRAWINGS

Further features and advantages of the present invention will become apparent from the following detailed description, taken in combination with the appended drawings, in which.

It will be noted that throughout the appended drawings, like features are identified by like reference numerals.

DETAILED DESCRIPTION OF THE PREFERRED EMBODIMENT

The present invention provides a drinking vessel, commonly referred to as a travel mug. The travel mug has an outer sidewall with a top rim that defines an open mouth from which a beverage can be consumed. An inner sidewall of the travel has an open top end for receiving a lid for closing the open top end. A fluid reservoir is defined between the outer sidewall and the inner sidewall. The fluid reservoir has a bottom surface that is spaced beneath the open top end of the inner sidewall. In one embodiment the outer sidewall, the inner sidewall and the bottom surface of the fluid reservoir are one integrated structure. The fluid reservoir collects any fluid that leaks between the inner sidewall and the lid and safely directs the leaked fluid to a mouth of a user when beverage is consumed from the travel mug.

Figure 1:
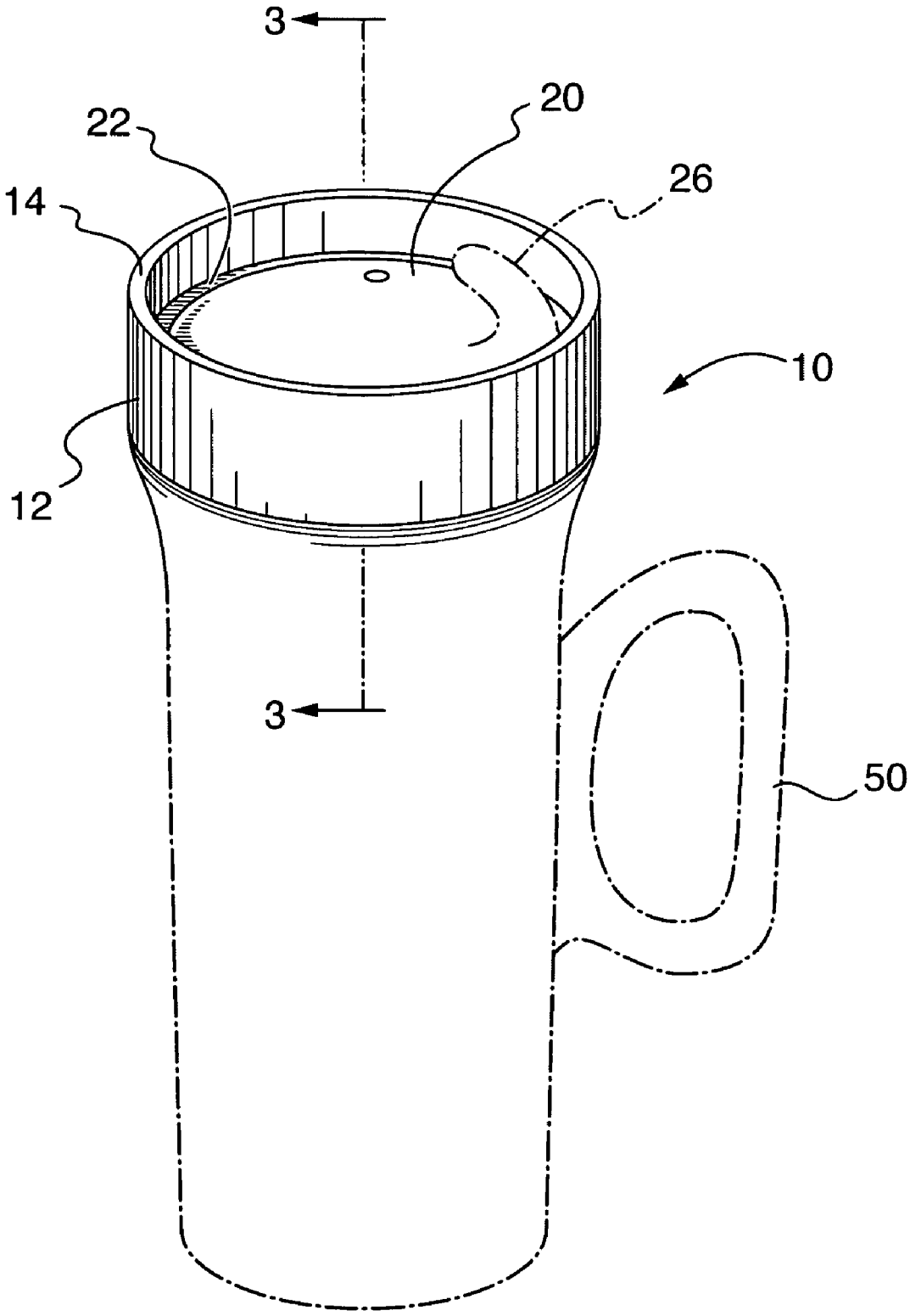
FIG. 1 is a perspective view of one embodiment of a travel mug in accordance with the invention.
Figure 3:
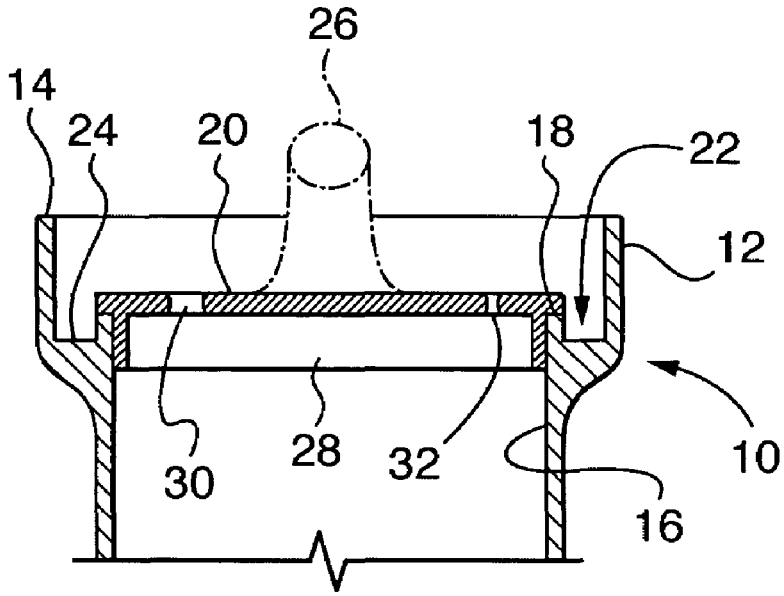
FIG. 3 is a cross sectional view taken along lines 3-3 of a travel mug shown in FIG. 1.

FIG. 1 is a perspective view of a travel mug in accordance with the invention, generally indicated by reference number 10. The travel mug 10 has an outer sidewall 12 having a top rim 14 that defines an open mouth from which a beverage can be consumed. As shown in FIG. 3, the travel mug 10 further includes an inner sidewall 16 having an open top end 18 for receiving a lid 20 for closing the open top end 18. A fluid reservoir 22 between the outer sidewall 12 and the inner sidewall 16 has a bottom surface 24 that is spaced beneath the top end 18 of the inner sidewall 16. The fluid reservoir 22 collects any beverage that leaks around the lid 20 to ensure that the beverage does not dribble down the outer sidewall 12 or drip onto the clothing of a user.

Figure 2:
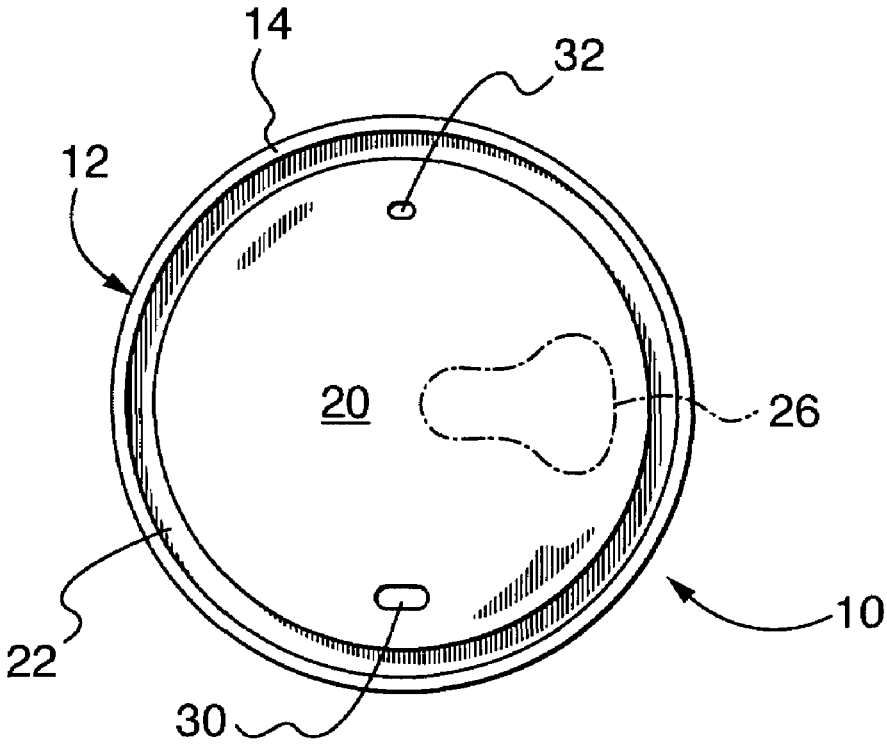
FIG. 2 is a top plan view of the travel mug shown in FIG. 1.

In the embodiment shown in FIGS. 1-3, the lid 20 is a friction fit lid well known in the art. In this embodiment, a handle 26 affixed to one side of the lid 20 provides a convenient grip for removing the friction fit lid from the open top end 18 of the inner sidewall 16. As shown in FIG. 3, a depending skirt 28 of the lid 20 provides the friction fit with the inner sidewall 16 to ensure that the lid 20 is not dislodged from the travel mug 10 unless it is purposely removed by a user gripping the handle 26. In the embodiment shown in FIGS. 1-3, the lid includes a first fluid passage 30 and a second fluid passage 32. The first fluid passage 30 provides a pathway for the beverage consumed. The second fluid passage 32 provides a pathway for air to enter as beverage flows through the first fluid passage 30. The size and shape of the first fluid passage 30 and the second fluid passage 32 are a matter of design choice. In general, the first fluid passage 30 is larger than the second fluid passage 32.

Figure 4:
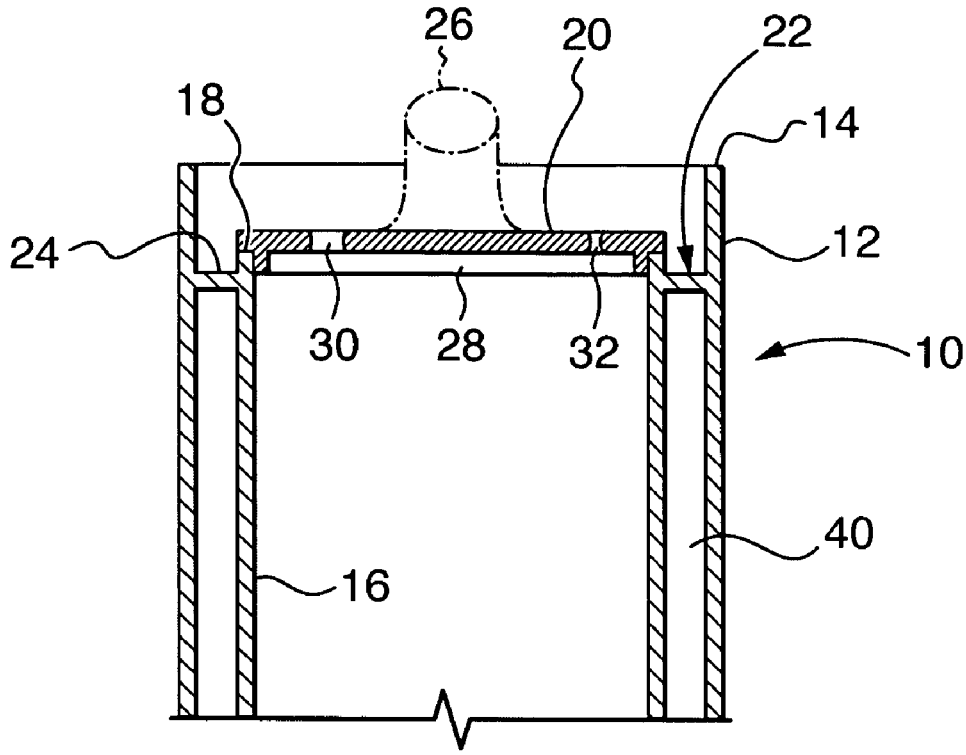
FIG. 4 is a cross sectional view of yet another embodiment of a travel mug in accordance with the invention.

FIG. 4 is a cross sectional view of another embodiment of the travel mug in accordance with the invention. The embodiment shown in FIG. 4 is identical to that described above with reference to FIGS. 1-3 with the exception that the outer sidewall 12 and the inner sidewall 16 are spaced apart and define a substantially hollow annular cavity 40 for providing an insulated mug to prolong maintenance of a temperature of the beverage. As is well understood in the art, the hollow annular cavity 40 may be filled with an insulating material.

Figure 5:
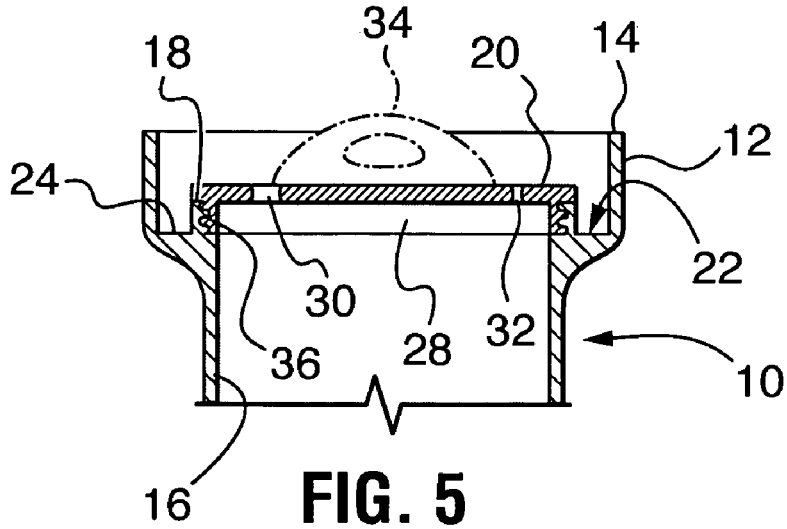
FIG. 5 is a cross sectional view of a further embodiment of a travel mug in accordance with the invention.

FIG. 5 illustrates a further embodiment of the invention, which is identical to that described above with reference to FIG. 3 except that the dispending skirt 28 of the lid 20 has a spiral thread generally indicated by reference number 36. The inner sidewall 16 includes a complementary spiral thread for securing the lid 20 to the open top end 18 of the inner sidewall 16. Since the lid 20 shown in FIG. 5 is rotated to engage the spiral threads 36, a handle 34, of any desired configuration, is preferably affixed to a center of the lid to facilitate rotation in a manner well known in the art.

Figure 6:
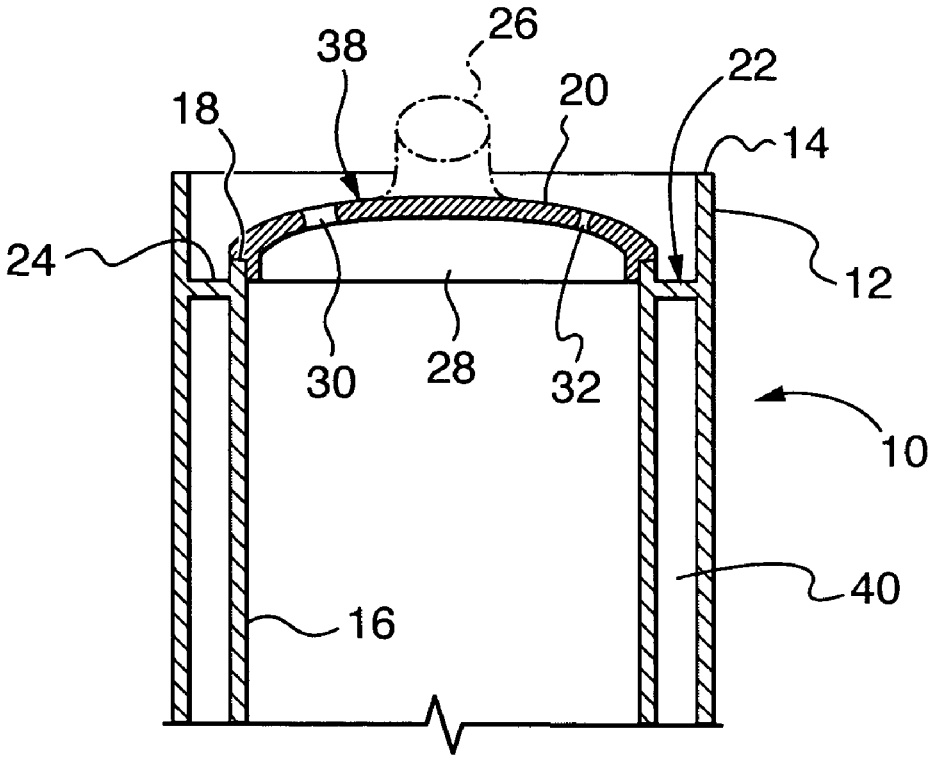
FIG. 6 is a cross sectional view of yet another embodiment of a travel mug in accordance with the invention.

FIG. 6 is a cross sectional view of yet another embodiment of the invention. The embodiment shown in FIG. 6 is identical to that shown in FIG. 4 with the exception that a top surface 38 of the lid 20 is convex. The convex top surface 38 urges beverage that flows through the first fluid passage 30 into the fluid reservoir 22 to keep the top surface 38 of the lid 20 clean and free of the beverage.

Figure 7:
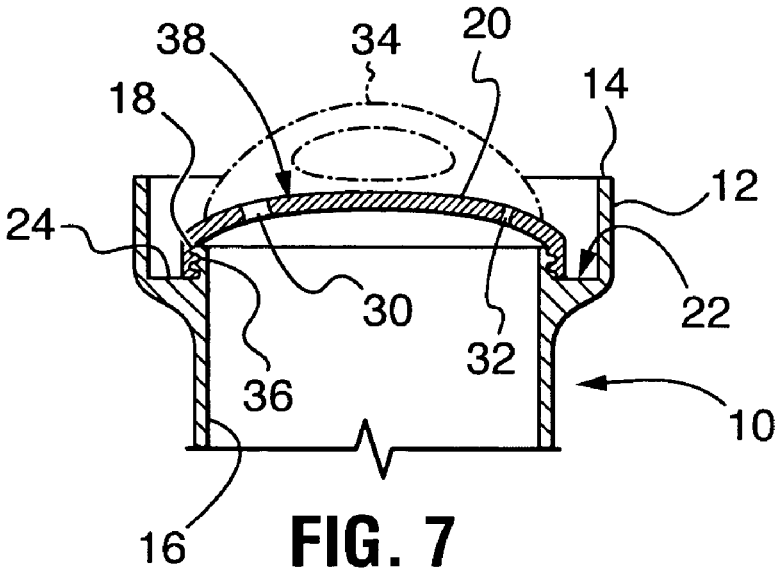
FIG. 7. is a cross sectional view of a further embodiment of a travel mug in accordance with the invention.

FIG. 7 is a cross sectional view of yet another embodiment of the invention. The embodiment shown in FIG. 7 is identical to that described above with reference to FIG. 5 with the exception that the spiral thread 36 is located on an outer side of the inner sidewall 16 and the lid 20 includes the convex top wall 38. The outer sidewall 12 and the inner sidewall 16 beneath the fluid reservoir 22 are opposite sides of a solid wall of the travel mug.

Figure 8:
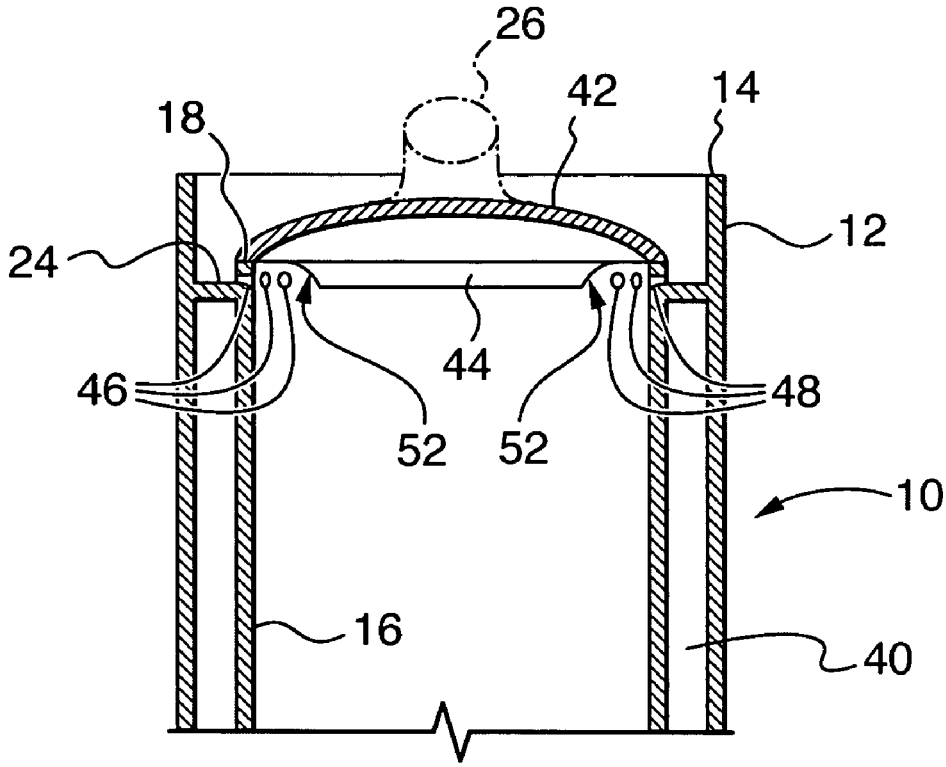
FIG. 8 is a cross sectional view of another embodiment of a travel mug in accordance with the invention.

FIG. 8 is a cross section view of yet another embodiment of the invention. In this embodiment, a lid 42 has a solid top surface with a depending skirt 44 having cut-away areas 52 to expose first fluid passages 46 located between the open top end 18 of the inner sidewall 16 and the bottom surface 24 of the fluid reservoir 22. The first fluid passages 46 permit beverage to flow out of the mug for consumption by a user. The second fluid passages 48 formed in the same way permit air to enter the mug as the beverage is consumed. As is well understood by those skilled the art, the lid 42 may be rotated so that the solid areas of the depending skirt 44 close the first fluid passages 46 and the second fluid passages 48 to provide a substantially leak proof mug when not is use. This further enhances temperature retention in the beverage.

Figure 9:
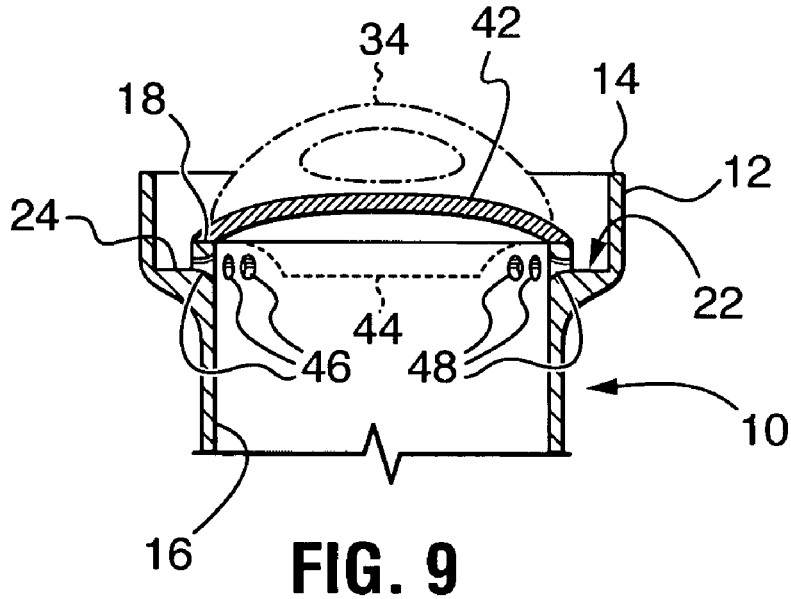
FIG. 9 is a cross sectional view of yet another embodiment of a travel mug in accordance with the invention.

FIG. 9 is a cross sectional view of yet a further embodiment of the travel mug 10 in accordance with the invention. The embodiment shown in FIG. 9 is identical to that described above with reference to FIG. 8, with the exception that the depending skirt 44 of the lid 42 frictionally engages an outer surface of the inner sidewall 16. The outer sidewall 12 and the inner sidewall 16 form opposite sides of a single sidewall of the travel mug 10. Furthermore, the handle 34 on the lid 42 facilitates rotation to close the first fluid passages 46 and the second fluid passages 48 using the depending skirt 44 when beverage is not been consumed from the travel mug 10.

Figure 10:
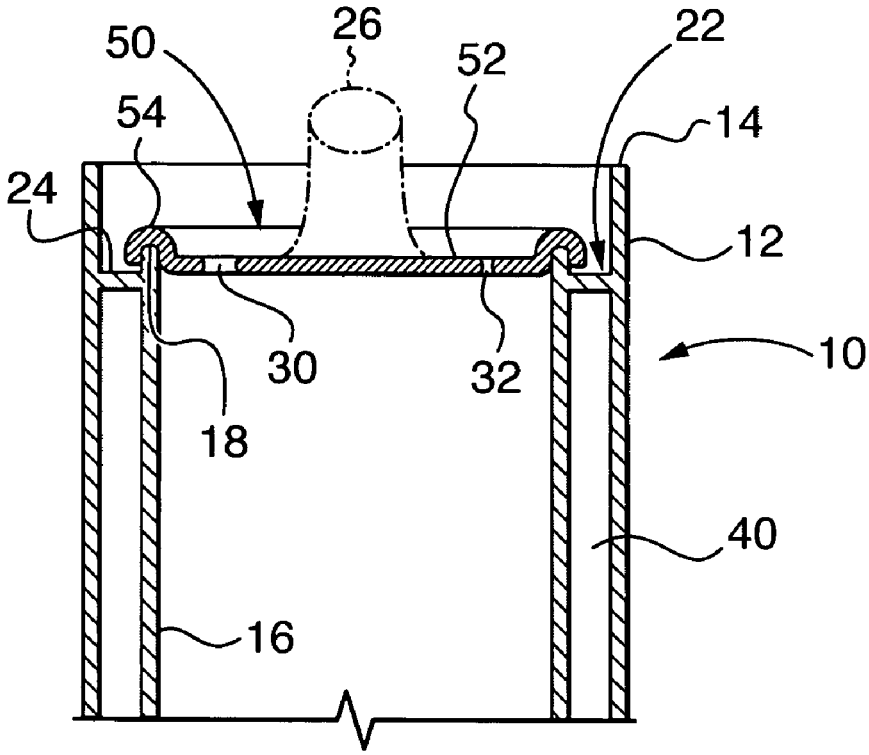
FIG. 10 is a cross sectional view of a further embodiment of a travel mug in accordance with the invention.

FIG. 10 is a cross sectional view of yet another embodiment of the invention. This embodiment is identical to the ones described above with reference to FIGS. 4 and 6 with the exception that the lid 50 is of a common friction fit design having a curved flange 54 that wraps over the open top end 18 to secure the lid to the travel mug 10. A handle 26 of a type described above is secured to the top surface 52 of the lid 50.

Figure 11:
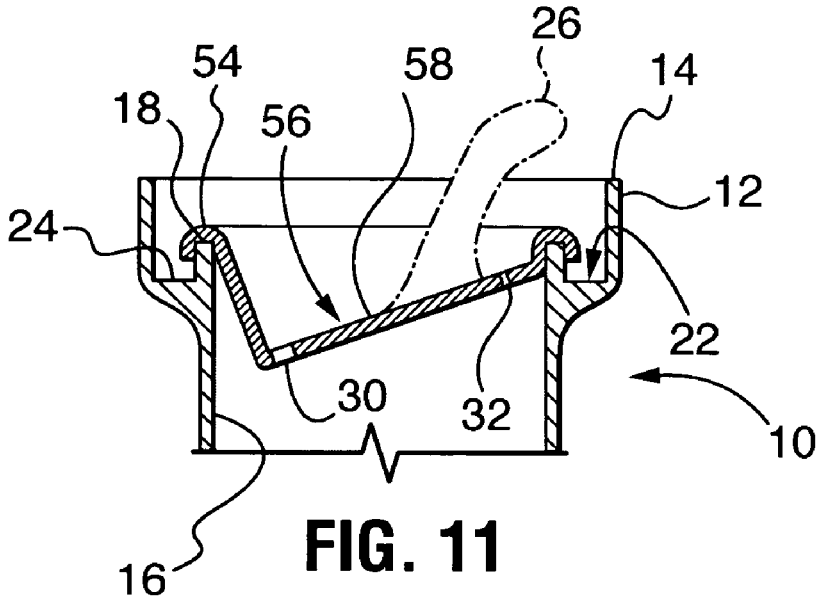
FIG. 11 is a cross sectional view of yet another embodiment of a travel mug in accordance with the invention.

FIG. 11 is a cross sectional view of still another embodiment of the invention. This embodiment is identical to the ones described above with reference to FIGS. 5 and 7 with the exception that the lid 56 is of a common friction fit design having a curved flange 54 that wraps over the open top end 18 to secure the lid 56 to the travel mug 10. In addition, a top surface 58 of the lid 56 is concave to ensure that any fluid left on the lid rapidly drains back into the travel mug 10.

As will be understood by those skilled in the art, the travel mug 10 shown in any of FIGS. 3-11 may or may not be equipped with a handle 50 as shown in FIG. 1. As will be further understood, the style of lid used with the travel mug 10 is immaterial and a perfect fluid-tight seal between the lid and the open top end 18 of the travel mug 10 is not required. It should be further be understood that although the travel mug 10 has been illustrated with several types of lids in several configurations, many other combinations of lid shape and closure mechanism are possible and within the spirit and scope of the invention.

The travel mug 10 provides a unique solution to significantly reducing the probability of dripping or leaking while a beverage is being consumed by a user. The travel mug 10 is easily constructed using plastic molding or metal spinning techniques which are well known in the art. The travel mug 10 may be constructed from food grade thermoplastics such as melamine or any other suitable polymer, or from food grade metals such as stainless steel, or any combination of plastic and stainless steel. The travel mug 10 is easily cleaned and provides a hygienic mug that does not drip or dribble fluids consumed therefrom.

The embodiments described above are intended to be exemplary only. The scope of the invention is therefore limited only by the scope of the appended claims.

I claim:

1. A leak-proof travel mug, comprising:

a jointless outer sidewall having a top rim defining an open mouth from which a beverage can be consumed;

an inner sidewall having an open top end for receiving a lid for closing the open top end in a fluid-tight seal, the lid including at least one fluid passage having a shape and size adapted to serve as a pathway for the beverage; and a fluid reservoir between the outer sidewall and the inner sidewall, the fluid reservoir having a bottom surface that is spaced beneath the open top end of the inner sidewall, and wherein the bottom surface of the fluid reservoir is elevated relative to a closed bottom end of the mug.

2. The travel mug as claimed in claim 1 wherein the lid comprises a curved flange that wraps over the open top end to secure the lid to the travel mug in a friction fit.

3. The travel mug as claimed in claim 1 wherein the lid comprises a first and second fluid passage, the first fluid passage providing a pathway for the beverage consumed and the second fluid passage providing a pathway for air to enter as beverage flows through the first fluid passage.

4. The travel mug as claimed in claim 1 wherein the inner sidewall comprises a first and second fluid passage located between the open top end and the bottom surface of the fluid reservoir, the first fluid passage providing a pathway for the beverage consumed and the second fluid passage providing a pathway for air to enter as beverage flows through the first fluid passage.

5. The travel mug as claimed in claim 1 wherein the lid comprises a friction fit lid.

6. The travel mug as claimed in claim 5 wherein the lid further comprises a handle connected to at least one side of a top surface thereof to facilitate removal of the lid.

7. The travel mug as claimed in claim 1 wherein a top surface of the lid is convex.

8. The travel mug as claimed in claim 1 wherein the lid is a threaded member that engages complementary threads on one of an inner and an outer side of the open top end.

9. The travel mug as claimed in claim 8 wherein a top surface of the lid is convex.

10. The travel mug as claimed in claim 8 wherein the lid further comprises a handle connected to a center of a top surface thereof to facilitate rotational movement for removal of the lid.

11. The travel mug as claimed in claim 1 wherein the outer sidewall and the inner sidewall below the fluid reservoir comprise opposite sides of a solid wall of the travel mug.

12. The travel mug as claimed in claim 1 wherein the outer sidewall and the inner sidewall below the fluid reservoir define a substantially hollow annular cavity for providing an insulated mug to prolong maintenance of a temperature of the beverage.

13. The travel mug as claimed in claim 1 wherein the travel mug and the lid are molded from a thermoplastic.

14. The travel mug as claimed in claim 1 wherein the travel mug is stainless steel and the lid is molded from a thermoplastic.

15. A leak-proof travel mug, comprising in combination:

a jointless outer sidewall having a top rim defining an open mouth from which a beverage can be consumed;

an inner sidewall having an open top end for receiving a lid for closing the open top end;

a fluid reservoir between the outer sidewall and the inner sidewall, the fluid reservoir having a bottom surface that is spaced beneath the open top end of the inner sidewall and wherein the bottom surface of the fluid reservoir is elevated relative to a closed bottom end of the mug; and the lid for closing the open top end in a fluid-tight seal comprises a first and second fluid passage, the first fluid passage providing a pathway for the beverage consumed and the second fluid passage providing a pathway for air to enter as beverage flows through the first fluid passage.

16. The travel mug as claimed in claim 15 wherein a top surface of the lid is convex.

17. The travel mug as claimed in claim 15 wherein the lid is a friction fit lid.

18. The travel mug as claimed in claim 17 wherein the lid further comprises at least one handle affixed to a side of a top surface thereof for facilitating removal of the lid.

19. A leak-proof travel mug, comprising in combination:

a jointless outer sidewall having a top rim defining an open mouth from which a beverage can be consumed;

an inner sidewall having an open top end for receiving a lid for closing the open top end in a fluid-tight seal;

a fluid reservoir between the outer sidewall and the inner sidewall, the fluid reservoir having a bottom surface that is spaced beneath the open top end of the inner sidewall; and the inner sidewall further comprises a first and second fluid passage located between the open top end and the bottom surface of the fluid reservoir, the first fluid passage providing a pathway for the beverage consumed and the second fluid passage providing a pathway for air to enter as beverage flows through the first fluid passage.

20. The travel mug as claimed in claim 19 wherein the inner sidewall comprises a plurality of first fluid passages and a plurality of second fluid passages.

* * * * *